United States Patent [19]

De La Mora

[11] 4,079,873

[45] Mar. 21, 1978

[54] CARRYING TRAY APPARATUS FOR AUTOMOTIVE VEHICLES

[76] Inventor: Juan De La Mora, 3043 S. Harding Ave., Chicago, Ill. 60623

[21] Appl. No.: 707,279

[22] Filed: Jul. 21, 1976

[51] Int. Cl.[2] ..... A47G 23/06

[52] U.S. Cl. ..... 224/48 R; 206/562; 220/8

[58] Field of Search ..... 224/29 R, 29 D, 45 R, 224/45 H, 48 R; 206/557, 562–565, 813; 220/8

[56] References Cited

U.S. PATENT DOCUMENTS

| | | | |
|---|---|---|---|
| 876,235 | 1/1908 | Quackenboss | 206/557 X |
| 946,977 | 1/1910 | Muller | 224/45 R X |
| 1,625,038 | 4/1927 | Love | 224/45 R |
| 1,895,061 | 1/1933 | Worssam | 220/8 X |
| 2,678,682 | 5/1974 | Thomas | 224/29 R |
| 2,704,928 | 3/1955 | Curry | 224/48 R X |
| 2,808,191 | 11/1957 | Cramer | 224/48 R X |
| 3,804,233 | 4/1974 | Gregg, Jr. | 224/29 R |
| 3,847,324 | 11/1972 | Uchanski | 206/813 X |
| 3,918,577 | 11/1975 | Horzick | 206/562 |
| 3,956,785 | 5/1976 | Halfon | 9/6 P |
| 4,007,828 | 2/1977 | Mayled | 220/8 X |
| 4,025,137 | 5/1977 | Wyler | 220/8 X |

FOREIGN PATENT DOCUMENTS

| | | | |
|---|---|---|---|
| 250,647 | 9/1947 | Switzerland | 220/8 |
| 1,546 of | 1909 | United Kingdom | 224/48 R |

*Primary Examiner*—Drayton E. Hoffman
*Assistant Examiner*—Donald W. Underwood
*Attorney, Agent, or Firm*—Alter and Weiss

[57] ABSTRACT

An adjustable carrying tray apparatus for transferring articles to and from an automotive vehicle. The tray supports articles, such as groceries and the like, for transferring such articles from outside the vehicle to the vehicle itself and for unloading the vehicle in a facilitated manner. Additionally, the adjustable tray has means by which the tray is securely restrained within the vehicle while the vehicle is moving, means for facilitated carrying of the tray by a user, and a series of apertures for secure placement of standard size containers to enable the transfer of a plurality of containers and packages in a minimum of unloading operations.

7 Claims, 5 Drawing Figures

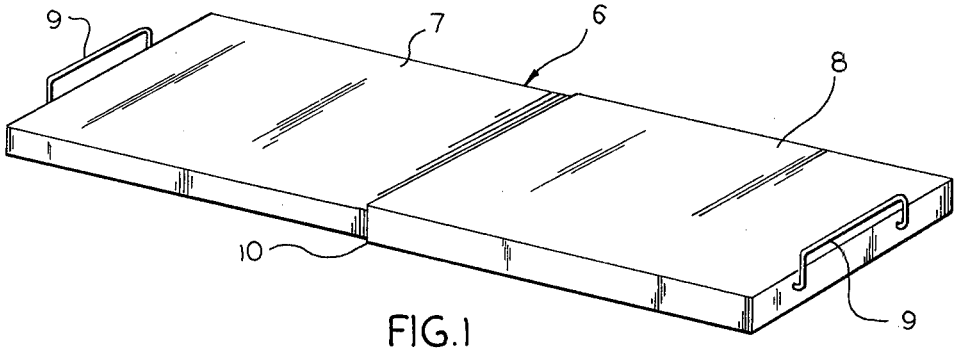
FIG.1
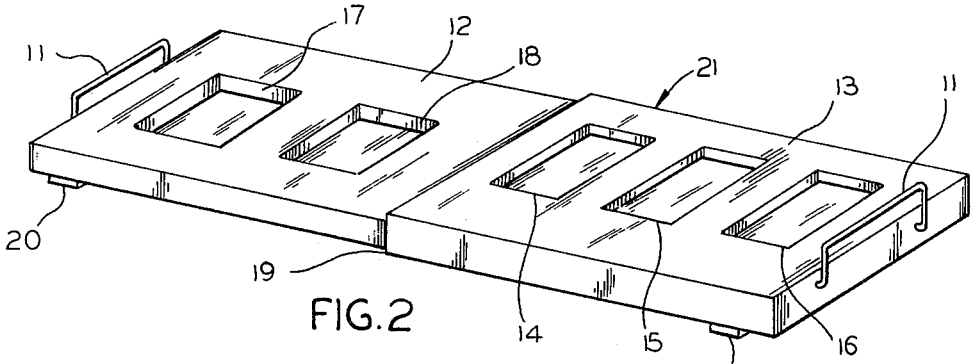
FIG.2
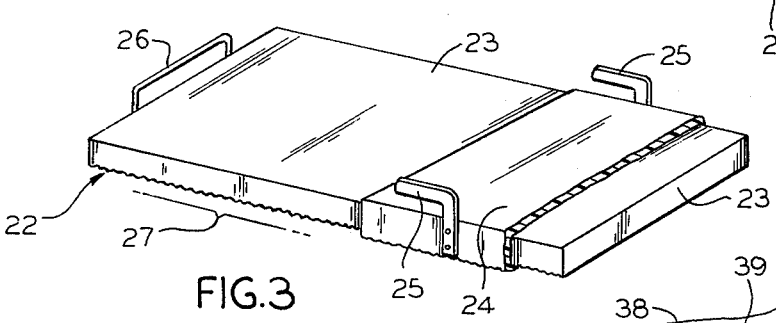
FIG.3
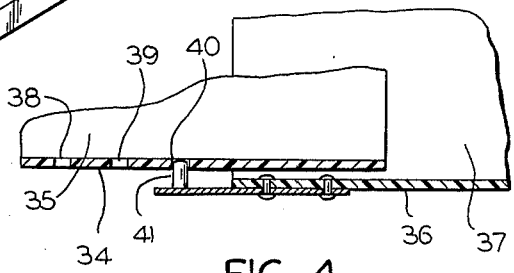
FIG. 4
FIG. 5
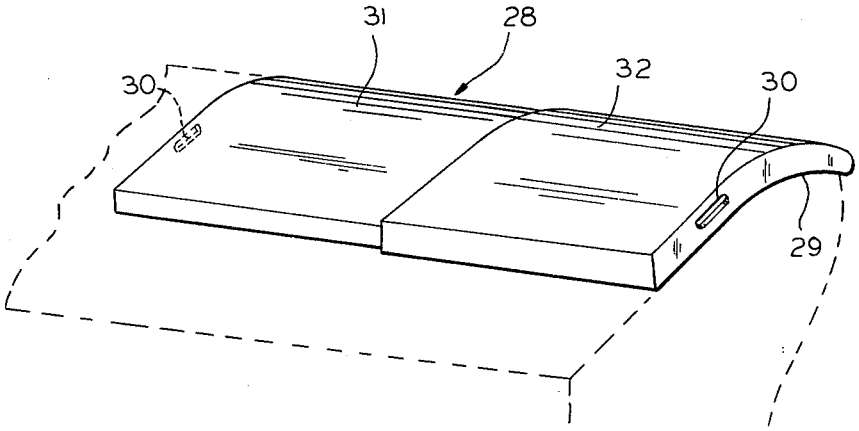

CARRYING TRAY APPARATUS FOR AUTOMOTIVE VEHICLES

BACKGROUND OF THE INVENTION

The present invention relates, in general, to portable carrying devices and, in particular, to an adjustable carrying tray apparatus for transferring supported articles to and from an automotive vehicle.

For literally hundreds of years, men have utilized a series of lifting and transportation tray-type devices to facilitate the movement of articles from one point to another. With the advent of automotive vehicles capable of travelling at high speeds and capable of starting and stopping rapidly, several problems were imposed on the use of carrying tray apparatus. Under rapid movement, conventional type trays, for example, have a tendency to slip along the seat or surface on which they are placed within the vehicle. Further, many conventional tray devices are of a rigid construction which have a tendency to take up an excessive amount of space within a vehicle and are not adjustable to facilitate the carrying of alternately large and small, heavy and/or light loads.

Many of the presently utilized tray devices fail to assist the user in several of the most widely needed applications. These applications comprise the use of such tray devices for the transferring of shopping containers from a grocery store to the vehicle and from the vehicle to a user's home. The vast majority of supermarkets presently utilize standard size shopping bags, and beverage cartons and containers which often tip over while in an automobile during movement of the vehicle. A conventional rigid tray allows the supported articles, namely the shopping bags and containers to freely slide relative to the tray, thus allowing a certain amount of outpour from a well filled bag, as well as tearing, spilling, and the like.

Accordingly, it is an object of the present invention to provide an adjustable carrying tray apparatus of a rugged, sturdy construction, for transferring supported articles to and from an automotive vehicle. Further, it is an object of the invention to be sufficiently portable and to provide several conveniently placed handle means to facilitate the carrying of these supported objects.

It is further an object of the invention that the tray apparatus telescope to reduce the amount of area it takes up within the vehicle when not being used, while at the same time enabling adjustment to a width which is appropriate for carrying a particular size load. In this respect, it is also an object that the tray apparatus be easily disassembled to further reduce the amount of space occupied by it towards enabling easier storage of the device within the trunk or any other area within the vehicle.

Similarly, it is an object of the invention to provide additional restraint and support to standard size grocery bags and containers to further facilitate the carrying of such containers and to enable the user to conveniently carry more of these containers at a time in order to reduce the number of trips necessary to load and/or unload a vehicle. Alternatively, the invention has, as one of its objectives, the adaptability of carrying not only groceries, shopping articles, but also laundry, picnic goods, and the like or, for that matter, any other article of reasonable shape and weight for transferral to and from an automobile.

It is additionally an object of the present invention to provide the rugged, adjustable carrying tray apparatus as described, while providing means in the form of shape and bottom surface devices for reducing the amount of sliding of the tray itself which can occur within a moving vehicle, as well as means on the top surface of the tray for restraining the object in place relative to the tray.

SUMMARY OF THE INVENTION

The present invention is an adjustable carrying tray apparatus for transferring supported articles to and from an automotive vehicle. The invention comprises a first substantially flat tray member which has a top and bottom side, as well as a second substantially flat tray member, also having a top and bottom side, but which has an internal dimension substantially equal to the first tray member, so as to telescopically receive the first tray member. The invention includes means for assisting the user to carry the tray and supported articles in the form of various handle means, as well as means for restraining the tray apparatus in place within the automotive vehicle, to thereby assist in the avoidance of slippage of the tray relative to the vehicle surface on which it rests.

The invention includes, as means for facilitated carrying of the tray and articles, protruding handle means on both the first tray member and the second tray member. In the preferred embodiment of the invention, the handle means on the first tray member are at one end of the telescoping member and oppositely face handle means equivalently positioned on the second tray. To further facilitate the carrying of the tray in both a position parallel to the user, or perpendicular to the user, another set of means for facilitating the carrying of the tray are included and comprise gripping means which are oppositely disposed on the sides of the second tray member. With this plurality of gripping means which can be seen to be attached to the receiving telescopic member along its sides, a separate set of carrying means is provided to the invention which avoids interference with the telescopic fit between the first and second tray members.

In yet another embodiment of the invention, the means for facilitated carrying of the tray and articles supported thereon, comprises recessed grooved handles on each of the first and second tray members with the grooved handle means on the first tray member positioned opposite the recessed grooved handle means on the second tray member, towards providing stability when the tray apparatus is being carried by a user.

Several means are provided for the invention which assist in the maintenance and restraint of the tray apparatus in place within the vehicle. In one embodiment of the invention the means for restraining the tray apparatus in place comprises the utilization of a textured surface on the bottom side of the first and second tray members. In yet another embodiment, the means for restraining the apparatus in place comprises the bottom surfaces of the first and second tray members, each having one or more strips of substantially adhesive or high friction material proximate to the outer exposed ends of each. In yet another embodiment of the invention, means for restraining the tray apparatus in place within the vehicle comprises the first and second tray members being contoured in shape to closely approximate the shape of the seat or surface of the vehicle upon which it is supported so that a portion of the tray tends to surround at least an edge of the vehicular seat or surface, to thereby promote the restrained placement of the tray apparatus and supported articles within the vehicle.

The preferred embodiment of the invention includes the utilization of latching means between the first and second tray members on the adjustable tray apparatus to thereby fix the placement of the first tray relative to the second tray. While ease in telescoping the first tray member within the second tray member is beneficial for purposes of storage or adjusting the tray to a desired width, once the desired width has been obtained, it is often desirable to constrain the first and second tray members relative to one another to avoid the accidental slippage of one tray relative to the other while articles are being carried, or while the tray and supported articles are in place within the moving automobile.

In order to more effectively restrain the position of the articles being carried relative to the first and second tray members upon which they are supported, the invention, in its preferred embodiment, utilizes a series of article template apertures to receive the tray supported articles in a more fixedly restrained manner. While these article template apertures may be shaped to closely approximate the size and dimensions of various specialized articles, the preferred embodiment of the invention utilizes article apertures which are shaped to closely approximate the shape of the bottoms of standard grocery containers, so as to facilitate the receipt of such container bottoms by the apertures, and thus the tray in a closely rigid and restrained manner.

BRIEF DESCRIPTION OF THE DRAWINGS

FIG. 1 of the drawings is a side perspective view of the adjustable carrying tray apparatus for transferring articles from an automotive vehicle, showing, particularly, the telescopic construction of its first and second tray members;

FIG. 2 of the drawings is a side perspective view of the invention thereof, showing utilization of article template apertures;

FIG. 3 is a side perspective view of the invention with a portion shown in section, showing, particularly, utilization of gripping means disposed along the second tray member;

FIG. 4 is a top sectional view of the tray apparatus, showing utilization of latching means thereon; and FIG. 5 is a side perspective view of the vehicle tray apparatus, particularly illustrating the construction in which the first and second tray members are contoured in shape to assist the restraint of the tray apparatus in an automotive vehicle.

DETAILED DESCRIPTION

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Adjustable carrying tray apparatus 6, as shown in FIG. 1 comprises first tray member 7, which is telescopically received by second tray member 8 at location 10. In this particular embodiment, the means for facilitated carrying of the tray and the supported articles, comprise handle means 9—9 located opposite one another on both the first and second tray members 7 and 8 respectively.

Adjustable carrying tray apparatus 21, is shown in FIG. 2 of the drawings. In the preferred embodiment of the invention, article template apertures 17 and 18 in first tray member 12, as well as article template apertures 14, 15 and 16, in second tray member 13 are utilized to restrain the supported articles relative to the tray. The article template apertures, such as apertures 14 through 18, receive the bottoms of the articles which are to be supported by tray 21. In the preferred embodiment, for example, apertures 17 and 18 could be adapted to accept the bottom of a standard size grocery bag, while apertures 14 through 16 would be shaped to accept the bottoms of soft drink bottle containers. As can be seen, by the telescoping of first tray member 12 into second tray member 13 at 19, the size of the tray and the number and type of templates available for use can be varied by the user towards maximizing the amount of items which could be carried conveniently by the tray and to in turn minimize the number of carrying operations necessary to remove or load the automotive vehicle.

Additionally shown in FIG. 2 are non-slid strips 20—20 of substantially adhesive or high friction materials, which assist in maintaining the tray in place on a seat or floor surface within the automotive vehicle, as well as handle means 11—11 for facilitated carrying of the tray and its supported articles.

Gripping means 25—25 are shown in FIG. 3 and enable the user to lift and carry the tray apparatus as desired in a position in which the longitudinal end of the tray is substantially perpendicular to the body of the user. Thus, when long, cumbersome articles are being carried which would be inconvenient to carry in the normal manner utilizing handle means 26, the tray can be utilized to allow the cumbersome articles to protrude forward from the user by relying on and utilizing alternative tray gripping means 25—25.

Tray apparatus 22 of FIG. 3 further shows the telescopic construction of the invention in which first tray member 23 is slidingly received by second tray member 24. Additionally, tray 22 utilizes means for restraining the slippage of the apparatus within the vehicle by utilizing textured surface 27 on the bottom sides of both the first and second trays to reduce such slippage towards further restraining the tray in place within the vehicle.

In the preferred embodiment of the invention, the position of the first tray member relative to the second tray member, besides being adjustable, is also restrainable through the latching means 41, as shown in FIG. 4. While many alternative means for latching the two tray members relative to one another can be used, this particular embodiment shows latch 41 penetrating orifice 40 in first tray member 35. As can be seen, latch 41 is capable of similarly penetrating orifices 38 and 39 to lock the first tray in yet other successive arrangements with regard to second tray member 37. Latch 41 is secured to vertical edge 36 of second tray member 37 and orifices, such as orifices 38, 39 and 40 are fabricated into the vertical side 34 of first tray member 35.

Other embodiments of the tray apparatus 28 are shown in FIG. 5 wherein both the first and second tray members are contoured along region 29, so as to closely approximate the shape of the seat 50 of the automotive vehicle to partially surround the one edge of the vehicle seat, here edge 51, to promote the restrained placement of tray 28 relative to the seat and the vehicle.

In this embodiment, as with the other previous embodiments shown, first tray member 31 and second tray member 32, are adjustable in telescopic fashion. Further, in this embodiment of the invention, recessed, grooved handle means 30—30 are utilized on both the first and second tray members on each end of these members respectively, and are positioned opposite one another. Such a recessed, grooved handle enables the user to firmly move the tray, while at the same time avoiding upwardly or outwardly protruding handles which may, in some cases, be deemed undesirable.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. An adjustable carrying tray apparatus for transferring supported articles to and from an automotive vehicle comprising:

a first substantially flat tray member having a substantially flat top and bottom side and a first outer edge between said top and bottom sides;

a second substantially flat tray member, having a substantially flat top side member and bottom side member spaced apart from said top side member by affixed lateral edge members and a second outer edge between said top and bottom side members, and having a total dimension substantially equal to said first tray member, so as to telescopically receive said first tray member between said top and bottom side members;

means for facilitated carrying of said tray and said supported articles by a user comprising protruding handle means on said first and second outer edges;

said handle means on said first outer edge facing opposite said handle means on said second outer edge, said means for facilitated carrying of said tray and supported articles additionally comprising rigidly affixed gripping means oppositely disposed along said lateral edge members of said second tray member and restrainably positioned in a direction substantially parallel to said lateral edge members whereby said tray apparatus may be alternatively handled by said gripping means when the telescopic pair of members are spaced so far apart that said handle means are unuseable, means for restraining said tray apparatus in place within said automotive vehicle thereby avoiding slippage of said tray and said articles within said vehicle when said vehicle is moving.

2. The invention according to claim 1 in which said means for restraining said tray apparatus in place within said vehicle comprises said bottom side of said first tray members and said bottom side member of said second tray member each having textured surfaces.

3. The invention according to claim 1 in which said means for restraining said tray apparatus in place within said vehicle comprises said bottom surfaces of said first and second tray members each having one or more strips of substantially adhesive materials proximate to the outer exposed ends of each.

4. The invention according to claim 1 in which said means for restraining said tray apparatus in place within said vehicle comprises said first and second tray members being contoured in shape to closely approximate the shape of a seat of said vehicle and surrounding at least one edge of said vehicle seat to promote restrained placement of said tray apparatus and supported articles.

5. The invention according to claim 1 in which said adjustable tray apparatus further includes latching means between said first and second tray members along said edge members to variably fix the placement of said first tray relative to said second tray in which said first tray otherwise freely telescopes as desired.

6. The invention according to claim 1 in which said top side of said first tray member and said top side member of said second tray member each have article template apertures to receive said tray supported articles in a more fixedly restrained manner, said bottom side of said first tray member being continuous and non-apertured to preclude the slipping of said article through said apparatus.

7. The invention according to claim 6 in which said article template apertures are shaped to closely approximate the shape of the bottoms of standard grocery containers so as to facilitate receipt of said container bottoms by said apertures in a close, rigid manner.

* * * * *